United States Patent [19]

Monauni et al.

[11] 4,315,544

[45] Feb. 16, 1982

[54] LOCKING DEVICE FOR LANDING WITHIN A WELL CONDUIT

[75] Inventors: Christian K. Monauni, Turriff, Scotland; Sidney J. Littleford, Dubai, United Arab Emirates

[73] Assignee: Baker International Corporation, Orange, Calif.

[21] Appl. No.: 3,154

[22] Filed: Jan. 15, 1979

[51] Int. Cl.[3] ..... E21B 23/02

[52] U.S. Cl. ..... 166/214; 166/136

[58] Field of Search ..... 166/214, 215, 206, 135, 166/136; 294/86.24, 86.25

[56] References Cited

U.S. PATENT DOCUMENTS

| | | | |
|---|---|---|---|
| 2,392,244 | 1/1946 | Hooser | 166/136 X |
| 2,991,835 | 7/1961 | Schwab | 166/214 |
| 3,856,081 | 12/1974 | Canalizo | 166/136 X |
| 3,874,447 | 4/1975 | McGowan, Jr. | 166/214 |

*Primary Examiner*—William F. Pate, III

*Attorney, Agent, or Firm*—William C. Norvell, Jr.

[57] ABSTRACT

An improvement is provided in an apparatus which is adaptable to be run within a subterranean well for the setting and locking of a locking module within the profile of a complimentary landing nipple carried on a conduit within the subterranean well. The improvement comprises a longitudinally extending probe means carried by the apparatus at one end. First receiving means are exteriorly defined on said probe means for selective receipt of a lock control member of a lock control means and for shifting of the lock control member to one of two positions. Second receiving means are provided on a locking module for selective receipt of the lock control means. Means on the apparatus are provided for shifting the lock control member to the other of the two positions while the lock control means is maintained in the receiving means. Use of the apparatus assures proper engagement of the locking module within the landing nipple profile prior to retrieval of the apparatus from within the well.

5 Claims, 3 Drawing Figures

LOCKING DEVICE FOR LANDING WITHIN A WELL CONDUIT

BACKGROUND OF THE INVENTION

1. Field of the Invention

The present invention relates to a unique locking device for use in conjunction with the sealing engagement of a safety valve mechanism, blanking plug device, or the like, within a conduit of a subterranean well.

2. Description of the Prior Art

The prior art is typified by the device as shown in FIG. 1, in which an apparatus 1 has defined at one end thereof a conventional fishing neck 2 for receipt therein of a fishing pin or other device of a running tool (not shown). The apparatus 1 typically has included utilization of a collet mechanism 3 having outwardly protruding finger elements for receipt within a complimentary profile of a landing nipple defining a portion of a well conduit, such as casing or tubing. The fingers of the collet 3 have been permitted to flex inwardly by a probing device carried on the running tool which urges a disc-like plunger device 4 to contact a compressible spring 5 therebelow, whereby affixation of the running tool within the fishing neck 2 causes the probe end to urge the plunger 4 downwardly and away from the fingers of the collet 3 and compress the spring 5. Thereafter, the fingers are enabled to contract inwardly and pass by obstructions defined on the casing or tubing of the well. When the apparatus 1 is located immediate the profile of the landing nipple, the running tool is retrieved from engagement on the fishing neck 2 by conventional means, such as by wire line, whereby the probe is shifted away from contact with the plunger 4 and the spring 5 is enabled to expand and urge the plunger 4 up against the fingers of the collet 3, thereby locking the fingers within the profile.

It can be easily seen that such an apparatus 1 would be deficient by enabling possible improper movement of the plunger 4 interior of the fingers whereby the apparatus 1 may be improperly or inadvertently set in, for example, a profile of the wrong nipple within the conduit or a tubing connection having a similar i.d. as the proper nipple profile. Such improper setting would, of course, not be normally detected until such time as the running tool is retrieved from the well. Consequently, upon discovery of such improper setting of the apparatus 1, the running tool would be required to be re-run into the well for retrieval and/or resetting of the apparatus 1. Obviously, such re-running is costly and time-consuming. Additionally, the construction of such prior art apparatus 1 obviously is not fail-safe, i.e., one is not assured that disengagement of the running tool from the apparatus 1 may be accomplished only after proper setting of the device within the landing or receiving nipple.

SUMMARY OF THE INVENTION

The present invention remedies the problems of typical prior art apparatuses by providing an apparatus which is adaptable to be run within a subterranean well for the running, selective setting and locking of a locking module within a complimentary landing nipple profile carried on a conduit within the subterranean well. The apparatus comprises a longitudinally extending probe means carried at one end thereof, with receiving means exteriorly defined on the probe means for selective receipt of a lock control member of a lock control means and for shifting of the lock control member to one of two positions. Means are provided for shifting the lock control member to the other of the two positions while the lock control means is maintained in the receiving means. A longitudinally extending locking module means initially carried by said apparatus and selectively disengagable therefrom is provided and includes exteriorly protruding locking elements for selective locking engagement within the landing nipple profile. Lock control means are carried within the locking module means and include at least one lock control member at one end thereof for selective receipt within the receiving means for selective shifting by the probe means, the lock control means also including a spring-compressing plunger element at the other end thereof which is responsively urged by the probe means to the other of the two positions while the lock control means is maintained in the receiving means. Second receiving means are provided on the locking module for selective receipt of the lock control means. The probe means urges the lock control means in one direction to one position whereby the locking module may be run along the second conduit and selectively received within the profile and the probe means thereafter shifts the lock control means out of the receiving means and into the second receiving means whereby the probe means may be thereafter retrieved from the well and the locking means is locked into the profile and maintained within the profile by the positioning of the lock control means.

DESCRIPTION OF THE PREFERRED EMBODIMENTS

Figure 1:
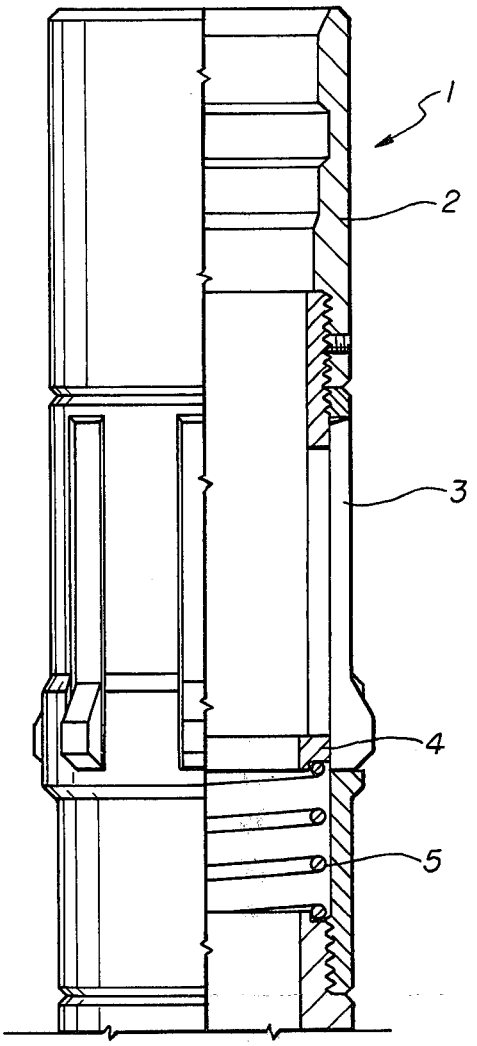
fig.1 (PRIOR ART)
FIG. 1 is a longitudinally extending cross-sectional view of a typical prior art apparatus, the lefthand side of FIG. 1 showing the exterior of the device, while the righthand side of FIG. 1 illustrates the interior thereof.
Figure 2:
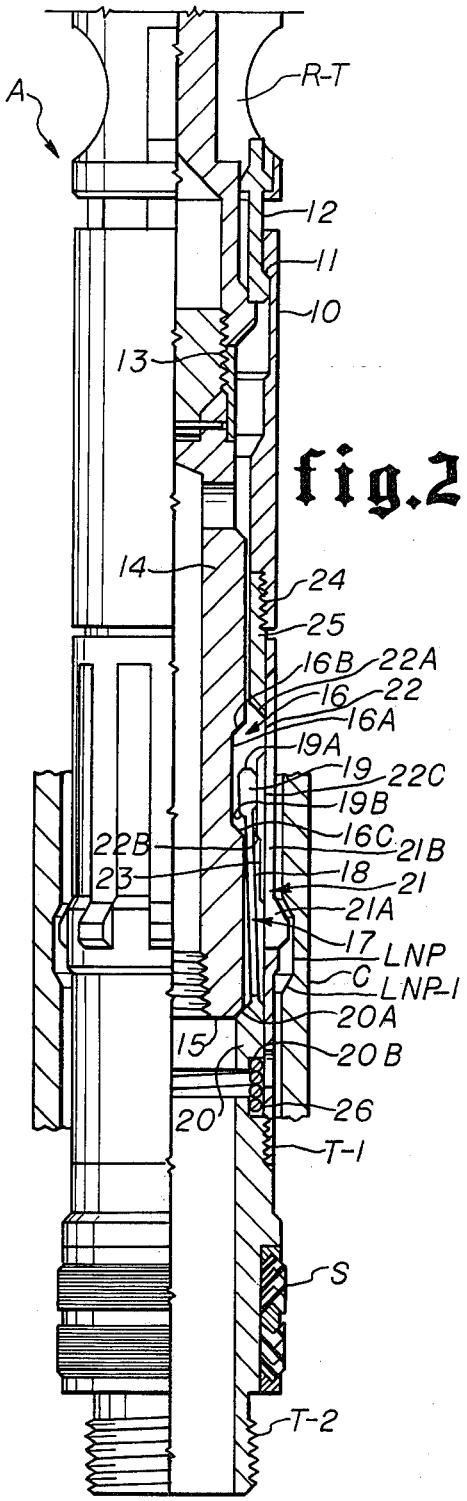
FIG. 2 is a longitudinally extending cross-sectional view showing the exterior and interior views of the apparatus of the present invention as it is run into a well conduit and received within the profile of a landing nipple formed on the conduit. The view of FIG. 2 is taken just prior to retrieval of the running tool and manipulation of the apparatus to the fail-safe locked position.

Referring now to FIG. 2, the apparatus A is affixed to the lower end of a conventional and commercially available running tool RT. The apparatus A has a longitudinally extending fishing housing 10 having defined thereon a profiled fishing neck 11 for complimentary interengagement with a fishing pin 12 of the running tool RT, whereby the running tool RT is selectively engagable to the apparatus A.

The running tool RT also is affixed to the apparatus A by means of threads 13 on a longitudinally extending probe 14 carried interior of the fishing housing 10.

The probe 14 has defined at its lowermost end an open end 15 for selective co-engagement with a complimentarily beveled edge 20A carried on a spring-compressing plunger 20. The probe 14 also defines thereon the first receiving means 16 comprising an inwardly beveled receiving groove 16A defined between upper and lower beveled shoulders 16B and 16C, for selective carriage of a lock control member, or finger, 19.

Forming a part of the apparatus A and affixed to the lower end of the fishing housing 10 by means of threads 24 is the lock control means 17, which is comprised of a flexible collet element 18 having at its upper end a series of circumferentially extending lock control members, or fingers, 19, which are flexible, and which are normally outwardly urgeable. Each finger 19 has an upper end 19A thereof for receipt and securement along the beveled wall 22A of a locking mandrel member 25. The upper end 19A also is contacted by the shoulder 16B of the probe 14 to initially urge the collet 18 downwardly and out of the second receiving means 22. Each finger 19 also defines an inwardly facing lower beveled end 19B for selective interengagement with a companion lower beveled shoulder 16C defining a portion of the receiving means 16, for carriage of the lock control means 17 by the probe 14 in an upward direction, as hereinafter described.

The collet 18 has defined at its lower end an enlarged spring-compressing plunger member 20 having thereon an engrooved spring end housing 20B for receipt of the upper end of a spring 26 for compression thereof. Additionally, the plunger 20 defines an inner smooth beveled edge 20A at its upper end for receipt of the open end 15 of the probe 14 when it is carried with the running tool RT for running within the well.

The lock control means 17 is carried around and housed within a locking module 21 defining a locking module collet 21B affixed around a locking module mandrel 25 which, in turn, is affixed to the fishing housing 10 by means of threads 24. The locking module collet 21B has a plurality of spaced, circumferentially extending, outwardly protruding locking elements, or fingers, 21A, for selective receipt and locking inner engagement with the landing nipple profile LNP carried on the conduit C.

The locking module means 21 defines on the collet 21B an engroovement, which is the second retrieving means 22, the engroovement 22 terminating at its lower end by a lower bevel 22B, and terminating, or defined at its upper end, by a similar but upwardly protruding bevel 22A, which is the lower face of the locking module mandrel 25. The lower bevel 22B is the upper face of a complimentary inner guide 23 formed interiorly of the collet 21B.

A compressible spring element 26 is carried at the upper end of a seal mandrel SM affixed by threads T-1 to the locking module means 21, thereabove, the spring 26 serving to urge the spring-compressing plunger 20 upwardly when the running tool RT is retrieved from the well to enable the lock control member, or fingers, 19 to be urged into locking position within the second receiving means 22.

A plurality of chevron seals S are carried on the seal member SM to sealingly engage the apparatus A within the well bore and along the conduit C. Threads T-2 at the lower end of the seal mandrel SM serve to affix the upper end of a mandrel or housing for a blanking plug, safety valve, or the like.

OPERATION

Figure 3:
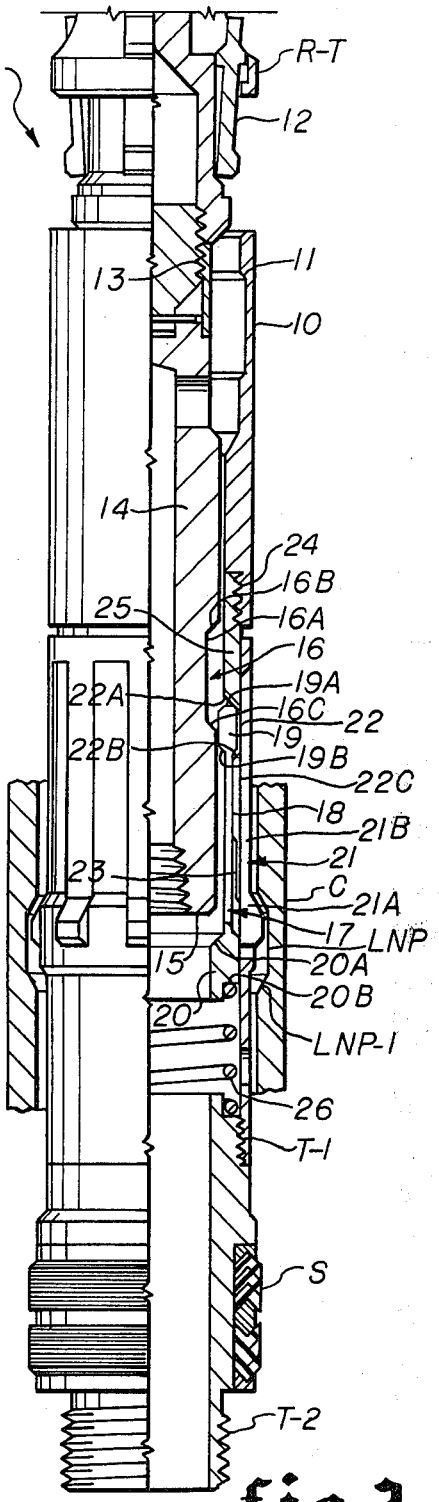
FIG. 3 is a view similar to that illustrated in FIG. 2, taken shortly after the running tool is disengaged from the other components of the apparatus, and illustrating the locking module means and the lock control means being interengaged to prevent disengagement therefrom from within the profile of the landing nipple.

As the apparatus A is run into the well on the running tool RT, the locking elements, or fingers, 21A of the locking module 21 are permitted to travel along the interior smooth wall of the conduit C. The spring 26 is in expanded position relative to the plunger 20, with the lock control members, or fingers, 19, being within the second receiving means 22, as shown in FIG. 3.

When the apparatus A is carried by the running tool RT to the depth in the well of the profile LNP on the conduit C, the locking element, or fingers, 21A will normally flex outwardly into engagement within the profile LNP. As further lower longitudinal travel of the apparatus A continues, the fingers 21A will become interengaged with the lower face LNP-1 of the landing nipple profile LNP, thus preventing further lower longitudinal travel of the locking module 21. Accordingly, the running tool RT continues to urge the apparatus A downwardly, slightly, whereby the upper beveled shoulder 16B of the probe 14 contacts and engages the upper end 19A of the lock control members, or fingers, 19, urging them out of the second receiving means 22, until such time as the open lower end of the probe 15 engages the beveled edge 20A of the spring-compressing plunger 20, and the spring 26 is fully compressed, whereby, further lower longitudinal travel of the apparatus A is prevented. When such resistance to lower travel of the apparatus A is detected at the well surface, the running tool RT is manipulated by conventional means such that the fishing pin 12 becomes disengaged from the fishing neck 11, and the running tool RT is moved within the well conduit C, upwardly. Concurrently, the lower beveled shoulder 16C of the probe 14 contacts and engages the companion lower beveled end 19B of the lock control members, or fingers, 19, to carry said members 19 upwardly and within the receiving means 16 on the receiving groove 16A thereof, until such time as the lock control members 19 come into latitudinal alignment with the second receiving means 22. Then, because the lock control members 19 are normally outwardly flexible, the members 19 will immediately flex into receiving engagement within the second receiving means 22 and be held therein between the upper and lower beveled walls 22A and 22B and along the wall 22C. Since such inner engagement between the lock control member 19 and the second receiving means 22 will prevent further engagement between the probe 14 and the collet 18, the probe 14 may be retrieved together with the running tool RT, thus separating the apparatus A. Now, the locking elements 21A are prevented from flexing inwardly and out of engagement within the landing nipple profile LNP because of the interengagement between the lock control members 19 and the second receiving means 22.

Now, it can be seen that any upward urging of the apparatus A will be translated through the locking elements 21A to the landing nipple profile LNP, and the locking elements 21A will not be able to be disengaged therefrom because the spring-compressing plunger 20 will now be interfaced interiorly of the locking elements 21A, to prevent inward contracting of the locking elements 21A out of locking engagement within the landing nipple profile LNP. This position is as illustrated in FIG. 3.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. In an apparatus adaptable to be run within a subterranean well for the setting and locking of a locking module within a complimentary profile of a landing nipple carried on a conduit within the subterranean well, the improvement comprising: longitudinally extending probe means carried by said apparatus at one end thereof; receiving means exteriorly defined on said probe means for selective receipt of a lock control member of a lock control means and for shifting of said lock control member to one of two positions; and means on said apparatus for shifting said lock control member to the other of said two positions while said lock control member is maintained in said receiving means, said lock control means comprising a collet defining at least one flexible finger at one end thereof and a plunger having an abutment thereon at the other end thereof, said plunger being responsively urged by said means on said apparatus for shifting said lock control member to the other of said two positions while said lock control member is maintained in said receiving means.

2. The improvement of claim 1 wherein said means on said apparatus for shifting said lock control member to the other of said two positions while said lock control member is maintained in said receiving means comprises: one end of said probe means.

3. The improvement of claim 1 wherein said lock control means comprises a collet defining at least one flexible finger at one end thereof and a spring-compressing plunger at the other end thereof, said plunger being responsively urged by said means on said apparatus for shifting said lock control member to the other of said two positions while said lock control member is maintained in said receiving means.

4. An apparatus adaptable to be run within a subterranean well for the running and selective setting and locking of a locking module within a complimentary landing nipple profile carried on a conduit within the subterranean well, comprising: longitudinally extending probe means carried at one end thereof; first receiving means exteriorly defined on said probe means for selective receipt of a lock control member of a lock control means and for shifting of said lock control member to one of two positions; means for shifting said lock control member to the other of said two positions while said lock control member is maintained in said first receiving means; longitudinally extending locking module means initially carried by said apparatus and selectively disengagable therefrom, said locking module means including exteriorly protruding lock elements for selective locking engagement within said landing nipple profile; lock control means carried within said locking module means and including at least one lock control member at one end thereof for selective receipt within said first receiving means and for selective shifting by said probe means; said lock control means further including a plunger having an abutment at the other end thereof, said plunger being responsively urged by said probe means to unlocked position relative to said locking elements while said lock control member is maintained in said first receiving means; and second receiving means on said locking module for selective receipt of said lock control member.

5. The apparatus of claim 4 wherein said probe means urges said lock control means in one direction to a position whereby said locking module may be run along said conduit and said locking elements selectively received within said profile, said probe means thereafter shifting said lock control element out of said first receiving means and into said second receiving means, whereby said probe means may be retrieved from said well, and said locking module is locked into said profile and maintained within said profile by the positioning of said lock control means.

* * * * *